US006932575B2

(12) United States Patent
Surace et al.

(10) Patent No.: US 6,932,575 B2
(45) Date of Patent: Aug. 23, 2005

(54) BLADE DAMPER

(75) Inventors: Raymond Surace, Middletown, CT (US); Dennis I. Colon, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/681,957

(22) Filed: Oct. 8, 2003

(65) Prior Publication Data

US 2005/0079062 A1 Apr. 14, 2005

(51) Int. Cl.[7] ..... F01D 5/26
(52) U.S. Cl. ..... 416/193 A; 416/500
(58) Field of Search ..... 416/190, 191, 416/193 A, 196 R, 248, 500

(56) References Cited

U.S. PATENT DOCUMENTS 4,872,810 A * 10/1989 Brown et al. ..... 416/145
4,872,812 A 10/1989 Hendley
5,226,784 A 7/1993 Mueller et al.
5,228,835 A * 7/1993 Chlus ..... 416/193 A
5,302,085 A 4/1994 Dietz et al.
5,369,882 A 12/1994 Dietz et al.
5,478,207 A 12/1995 Stec
5,513,955 A * 5/1996 Barcza ..... 416/95
5,827,047 A * 10/1998 Gonsor et al. ..... 416/193 A

FOREIGN PATENT DOCUMENTS

EP 1167691 A2 1/2002
JP 402095702 A 4/1990

* cited by examiner

*Primary Examiner*—Ninh H. Nguyen
(74) *Attorney, Agent, or Firm*—Bachman & LaPointe, P.C.

(57) ABSTRACT

A turbomachine blade damper has a damper member with first and second damping surfaces for respectively engaging first and second surfaces of adjacent first and second blades. The damper has a seal having a first portion engaged in the damper member to resist relative movement of the seal in at least one direction and a second portion engaging at least one of the blades and advantageously forming a seal to resist upstream gas infiltration.

22 Claims, 12 Drawing Sheets

BLADE DAMPER

U.S. GOVERNMENT RIGHTS

The invention was made with U.S. Government support under contract N00019-02-C-3003 awarded by the U.S. Navy. The U.S. Government has certain rights in the invention.

BACKGROUND OF THE INVENTION (1) Field of the Invention

The invention relates to turbomachinery. More particularly, the invention relates to dampers for damping relative motion of adjacent blades in a turbomachine rotor.

(2) Description of the Related Art

A typical gas turbine engine has, in its compressor and turbine sections a number of blade-carrying disks that rotate about the engine axis and are interspersed with arrays of vanes that do not. The periphery of each disk may have a circumferential array of convoluted blade retention slots which receive complementary root portions of associated blades. Neck portions of the blades extend outward to platform sections which have outboard surfaces that help to locally define an inboard surface of the core flowpath through the engine. The blade airfoil extends from a root at the platform outboard surface to an outboard tip. Thermal and mechanical stresses and wear can produce relative motion of adjacent blades. It is accordingly known to provide dampers between the platforms of adjacent blades. An exemplary damper is shown in U.S. Pat. No. 4,872,812. Substantial ongoing efforts exist in improving blade damper technology.

SUMMARY OF THE INVENTION

Accordingly, one aspect of the invention involves a turbomachine blade damper. A damper member has first and second damping surfaces for respectively engaging first and second surfaces of adjacent first and second blades. A seal has a first portion engaged to the damper member to provide location of the seal in at least one direction and a second portion for restricting gas flow by at least one of the blades.

In various implementations, the seal may consist essentially of sheet metal and the damper member may consist essentially of cast or machined metal. Each may consist essentially of a nickel- or cobalt-based superalloy. The seal may be retained by the damper member against axial movement in at least one direction and against inward radial movement. One of the damping surfaces may have a radiused transverse section. The other damping surface may be relatively flat. The seal second portion may be at least partially wider than the damper member. That second portion may have a radial span of at least 2.0 mm and a circumferential span of at least 4.0 mm. The circumferential span may be effective so that first and second side portions of the second portion are accommodated within pockets of adjacent blades. The second portion may be, in major part, radially inboard of the damping member. The damper member may have a depending T-shaped projection. The seal may have a closed aperture accommodating a leg of the projection with an adjacent portion of the seal being captured by an underside of a head of the projection. The adjacent portion may be freed by a relative rotation about an axis of the leg to an orientation wherein the projection head may be extracted through the aperture. In a method of assembly, the damper member and seal may be brought together in a first orientation so that the projection passes into the aperture. The damper member and seal are then relatively rotated to a second orientation wherein the projection captures an adjacent portion of the retainer.

Another aspect of the invention involves a turbomachine blade combination. First and second blades each have a root, an airfoil outboard of the root, and a platform and neck between the root. The combined platform and neck has first and second sides, the first side of one of the blades facing the second side of the other. Means are mounted in at least one pocket of at least one of the facing first and second sides for damping relative motion of the first and second blades and sealing against combustion gas upstream infiltration.

In various implementations, the means may include a one piece seal member and a one piece damper member that further provides a degree retention for the seal member.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
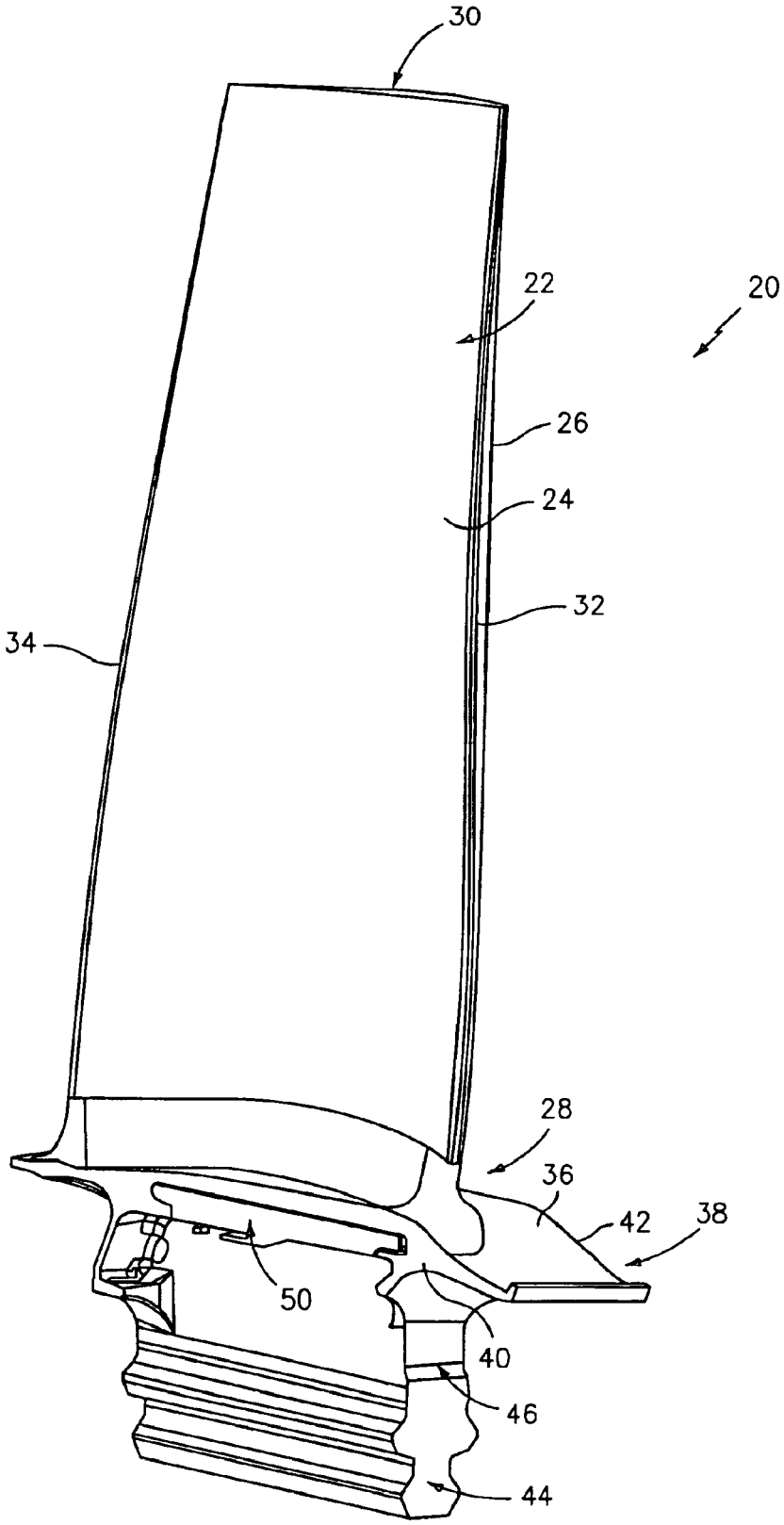
FIG. 1 is a view of a blade and damper assembly combination.

FIG. 1 shows a blade 20 having an airfoil 22 with concave pressure and convex suction side surfaces 24 and 26 extending from an airfoil root 28 to an airfoil tip 30 and between leading and trailing edges 32 and 34. The airfoil root is formed at an outboard surface 36 of a platform 38 having first and second sides 40 and 42. The platform is outboard of a convoluted root 44 and separated therefrom by a neck 46. A wedge damper/seal assembly 50 is partially accommodated within a compartment in the platform and neck combination.

Figure 2:
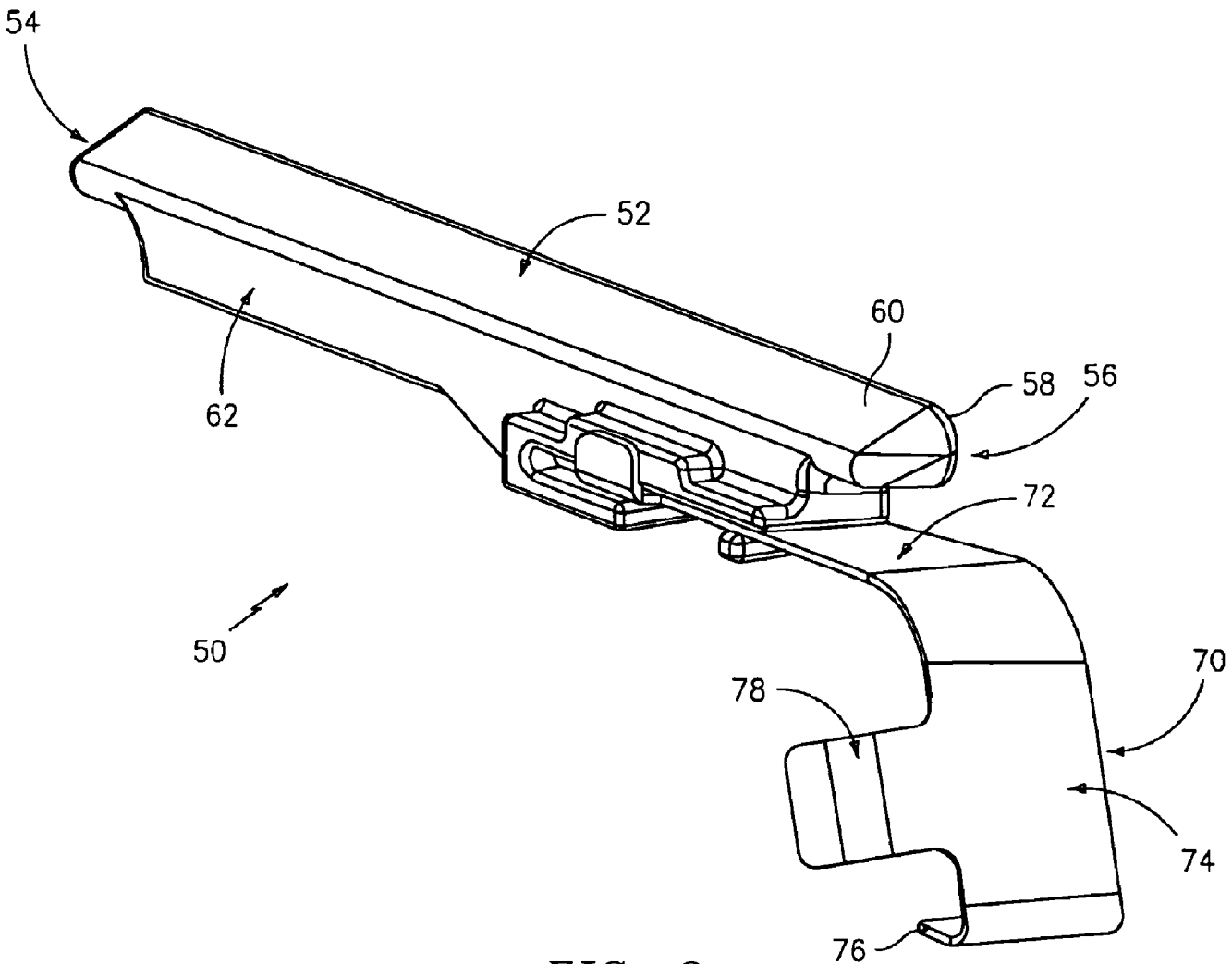
FIG. 2 is a view of the damper assembly of the blade of FIG. 1.
Figure 3:
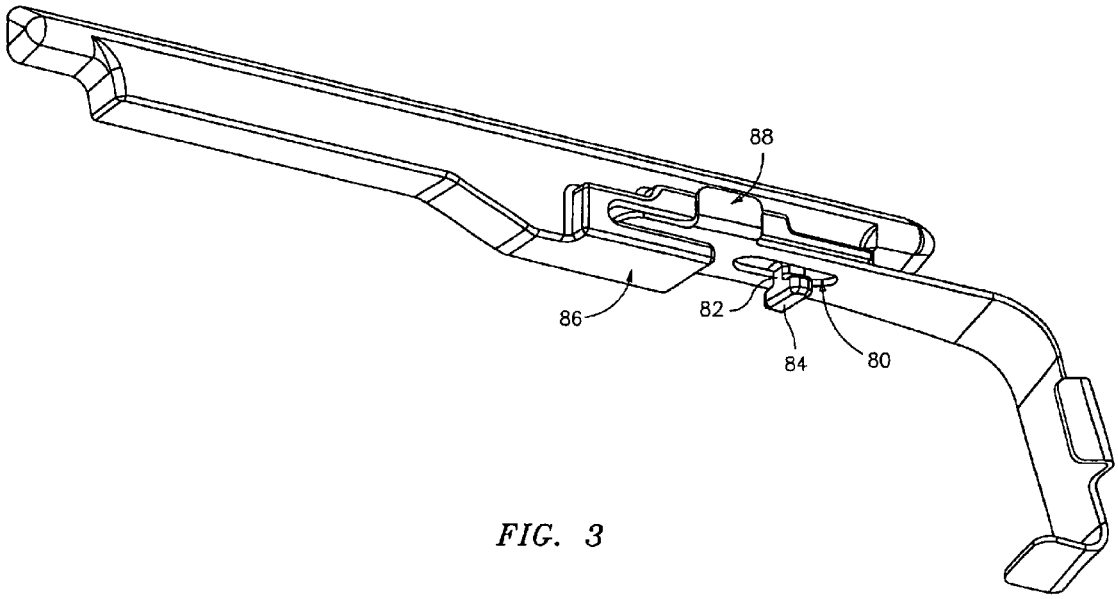
FIG. 3 is a second view of the damper assembly of FIG. 2.
Figure 4:
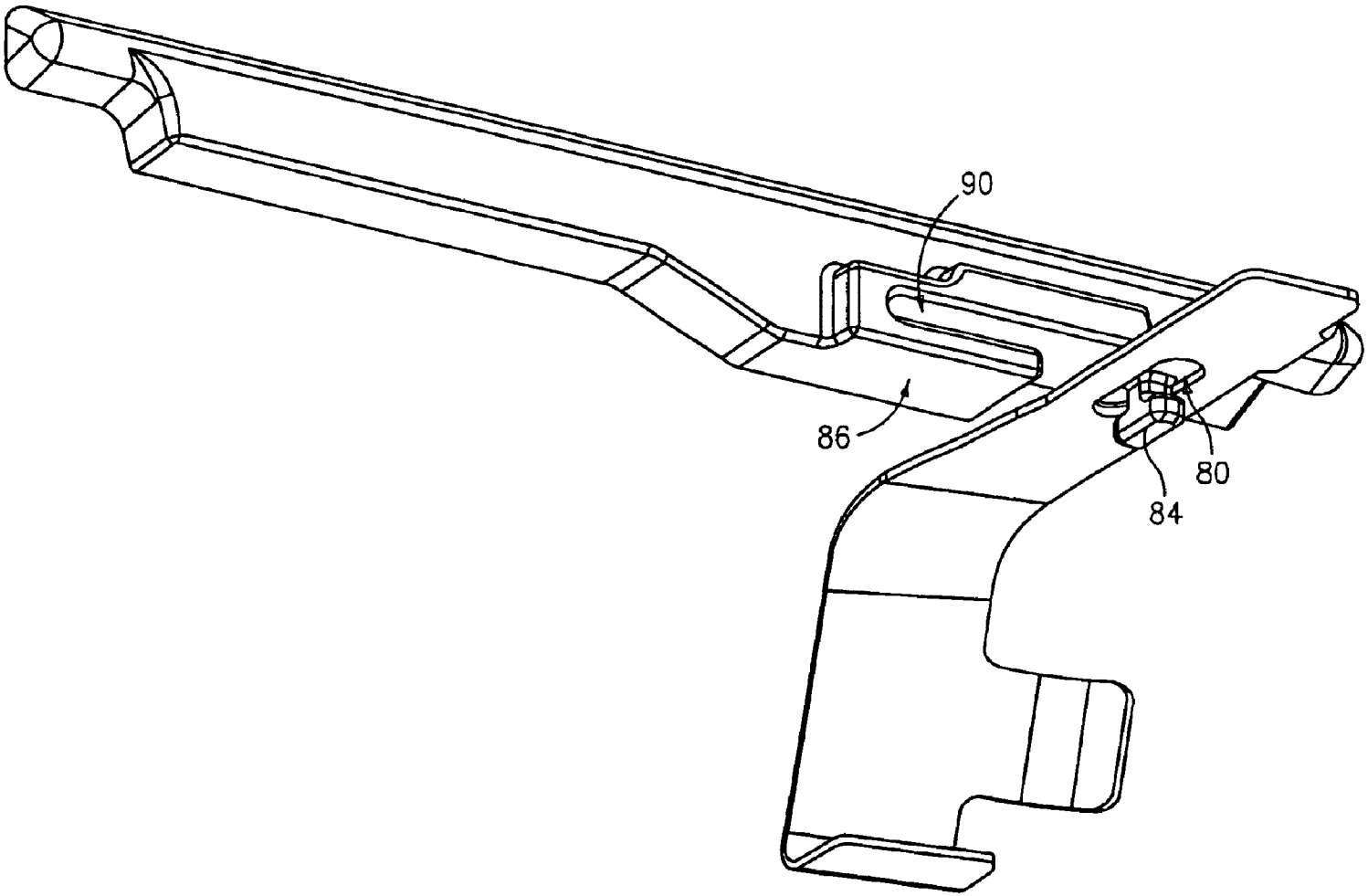
FIG. 4 is a third view of the damper assembly of FIG. 2 in a state of partial assembly/disassembly.

FIG. 2 shows further features of the exemplary damper/seal assembly 50. A main body portion of a damper member 52 extends from an upstream end 54 to a downstream end 56 and has first and second damping surfaces 58 and 60. An underhung mass 62 depends inboard from the main portion of the damper member. A seal member 70 has an outboard shelf portion 72 for engaging the damper member. A depending portion 74 depends generally inboard from the shelf 72 and terminates in a bent under tab 76. A tri-bent tab 78 extends from a second side of the depending portion 74 and is bent partially upstream. In the exemplary embodiment, the damper member and seal member are each formed as a unitary metal piece. Exemplary damper members may be cast or machined and exemplary seal members may be stamped and bent from sheet stock. Exemplary materials for each are nickel- or cobalt-based superalloys. In particular, preferred damper material is an equiax nickel-based superalloy such as Inconel Alloy 100, Special Metals Corporation, Huntington, W.Va. and preferred seal member material is a cobalt-based superalloy such as Haynes 188, Haynes International, Inc., Kokomo, Ind. Exemplary seal member thickness is 0.20 mm–1.5 mm, more narrowly, 0.25 mm–0.80 mm. Both seal and damper member materials advantageously have high temperature reliability, at least in excess of 650° C. and, preferably, near or in excess of 1100° C. The damper member and seal member may have interengageable features with mating surfaces for permitting the seal member to be retained by the damper member. In the illustrated embodiment of FIG. 2, cooperating surfaces include an upstream outboard surface portion of the shelf 72 and a downstream inboard surface portion of the underhung mass. FIG. 3 further shows that portion of the shelf as having a slot-like aperture 80 elongate in the longitudinal direction and accommodating the leg 82 of a T-shaped projection depending from the underhung mass underside and having a transversely-extending head 84 whose outboard-facing underside captures portions of the shelf along sides of the aperture to prevent the relative inboard movement of the seal member relative to the damper member. FIG. 3 further shows a downstream protruding tongue 86 of the underhung mass below a leading portion of the shelf 72 and whose outboard surface engages an underside of the upstream portion of the seal shelf to further prevent such translation. The shelf further includes an outboard-extending tab 88 along its second side and having a surface contacting an adjacent second side surface of the underhung mass to resist relative rotation of the seal member in a first direction about an axis of the leg 82. With the foregoing in mind, the damper and seal assembly 50 may be assembled by initially translating the two together in an orientation transverse to their assembled orientation so that the projection head 84 (FIG. 3) is aligned with and passes through the aperture 80. The seal is then rotated in the first direction about the leg 82 to bring to the shelf upstream portion into a channel 90 outboard of the tongue 86 until the tab 88 contacts the adjacent side of the damper member.

Figure 5:
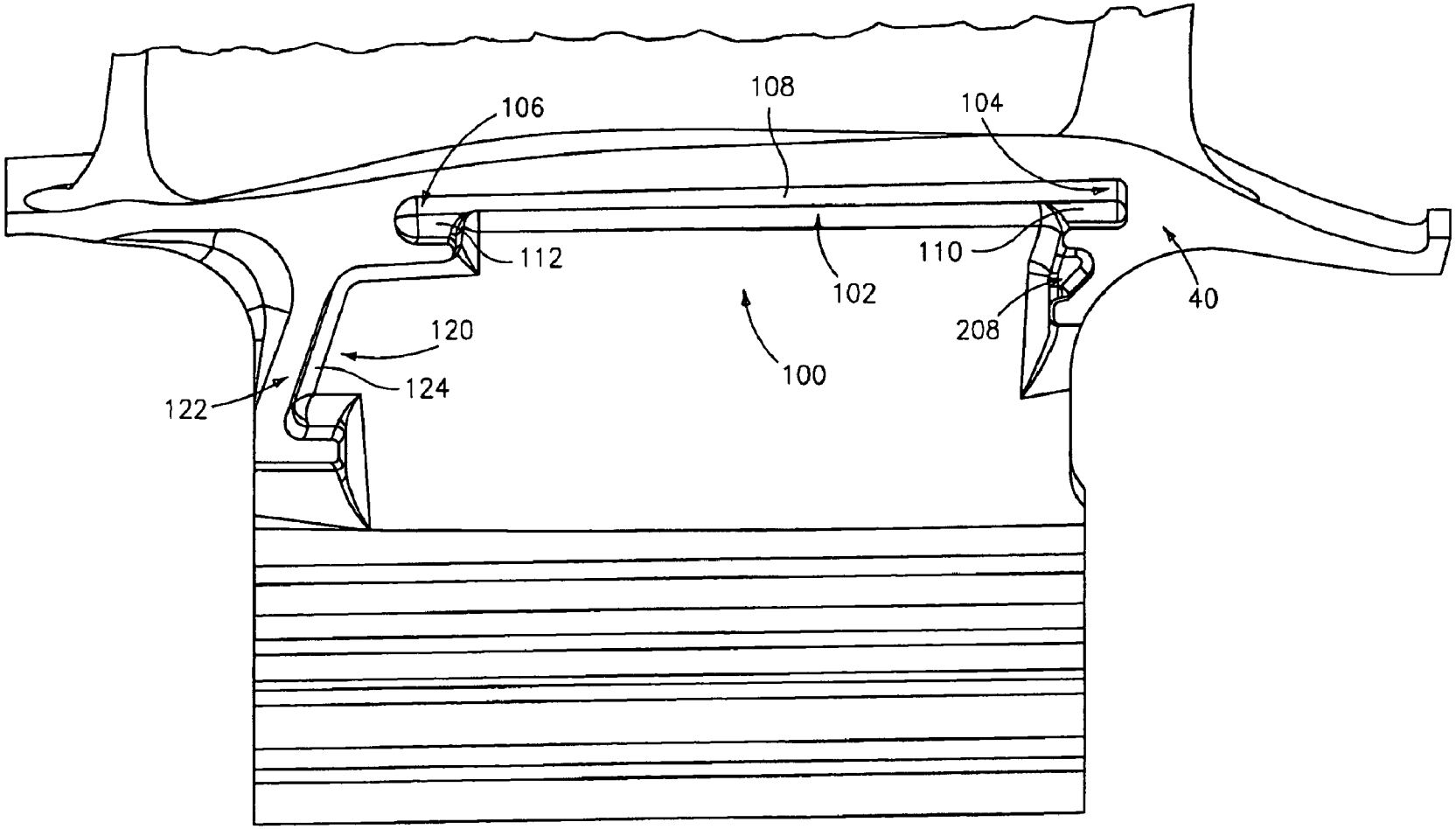
FIG. 5 is a view of a blade pressure side platform and neck area having surfaces for engaging one side of the damper assembly of FIG. 2.

FIG. 5 shows further details of the first side pocket 100 for accommodating the damper/seal assembly. The pocket has a first portion 102 essentially in the platform and extending from an upstream end 104 to downstream end 106 and having a bearing surface 108 for engaging the damper member main body second surface 60. The surface 108 extends continuously along an outboard extremity of the pocket first portion 102. Adjacent the ends 104 and 106, the pocket is also bounded by inboard surface portions 110 and 112 which help capture upstream and downstream end portions of the damper member main body against relative inboard movement beyond a given range. A pocket second portion 120 is formed essentially in an aft downstream buttress 122 of the neck and has an upstream-facing surface 124. The second portion 120 accommodates a second-side portion of the seal depending portion including the associated tab 78. The interaction between pocket portion 120 and tab 78 helps to locate the seal circumferentially between adjacent blade pockets.

Figure 6:
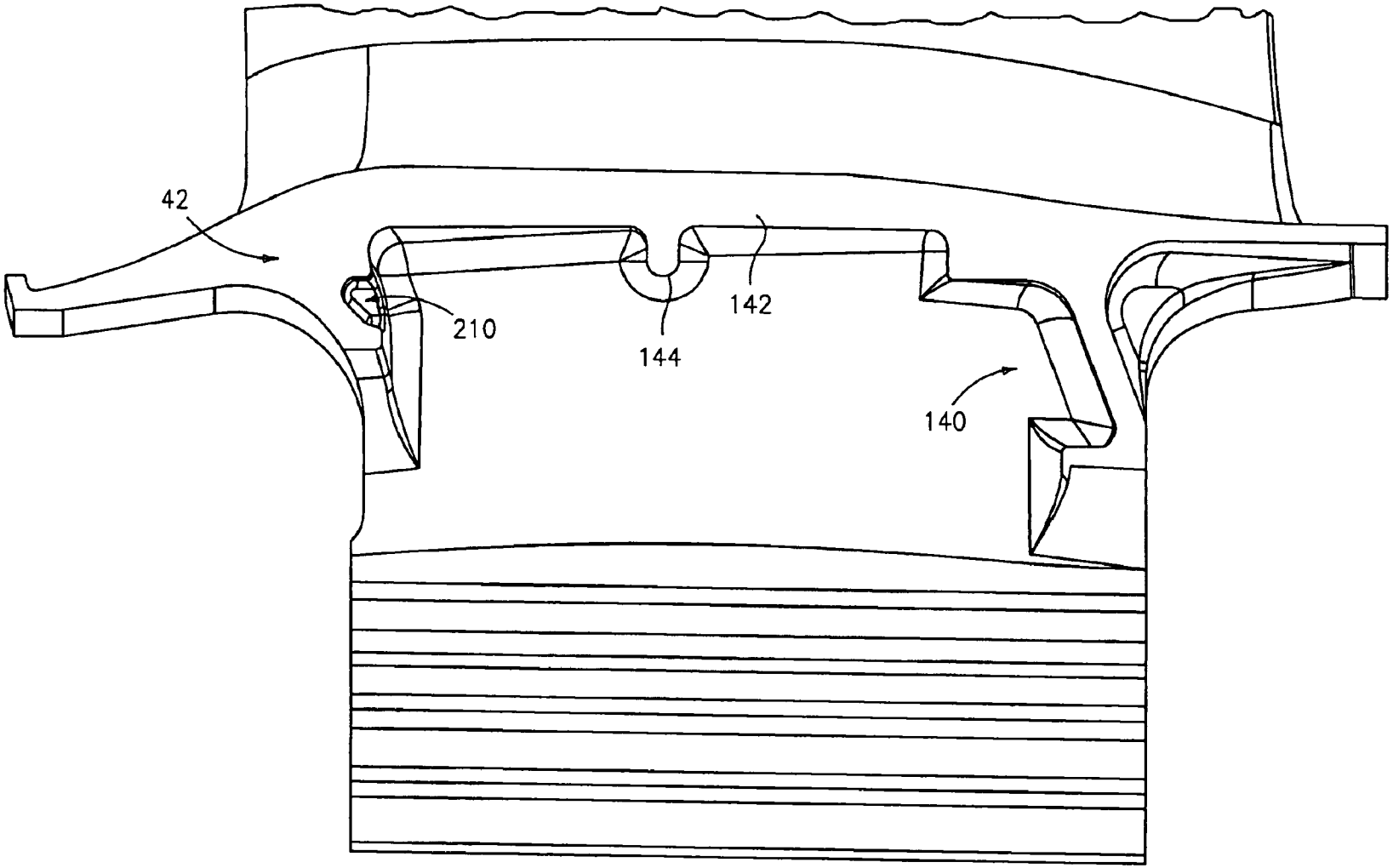
FIG. 6 is a view of a blade suction side neck area having surfaces for engaging a second side of the damper assembly of FIG. 2.

FIG. 6 shows the second side 42 of the blade which may be in close facing spaced-apart relation to the first side 40 of the adjacent blade. A pocket 140 is formed in the aft buttress for receiving the first side portion of the seal member depending portion. The platform includes a surface 142 positioned to engage the first side of the damper member main body portion. The surface 142 extends longitudinally for substantially the length of the damper member and has a portion along a central depending projection 144. The projection 144 provides additional blade-to-damper contact area and damper anti-rotation when brought into contact with the first damping surface 58. With the blades assembled, the seal member depending portion and downstream section of the shelf portion span between the pockets of adjacent blades to help form a seal between the adjacent blades against upstream infiltration of hot gases.

Figure 7:
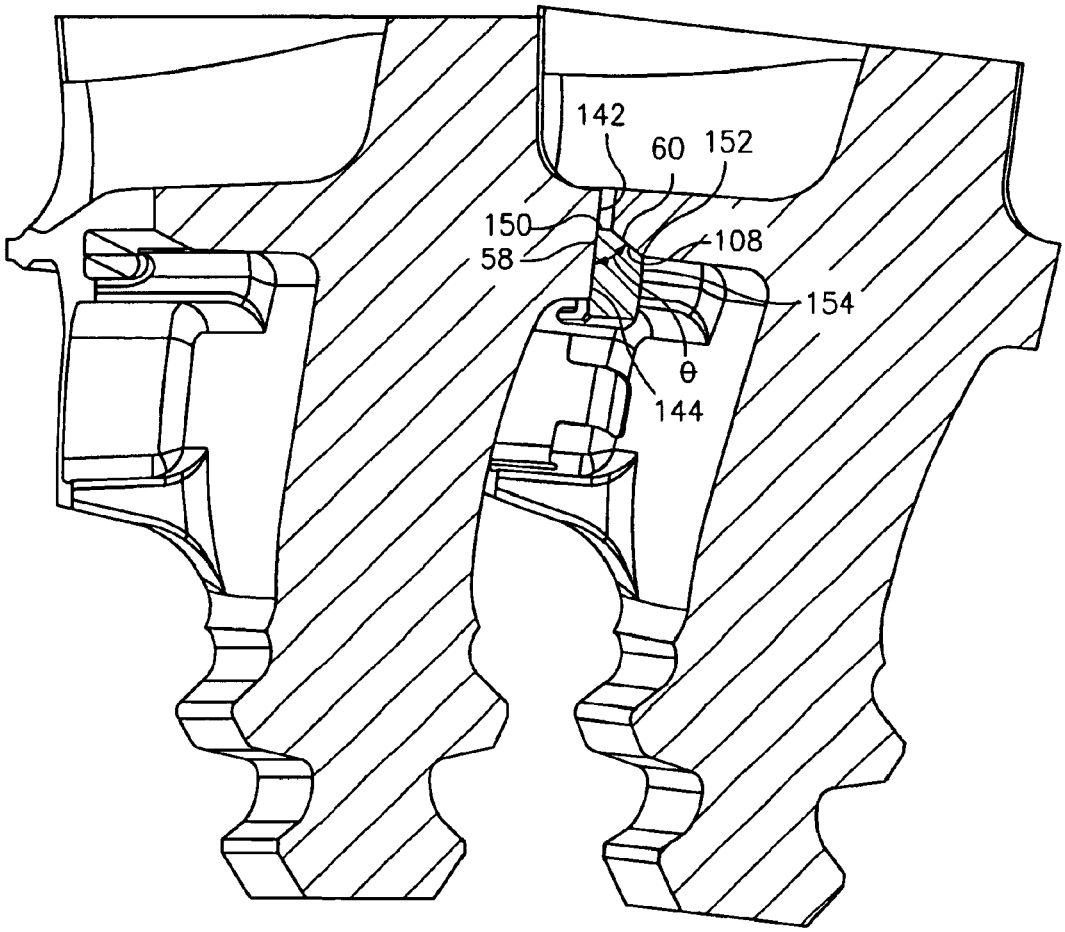
FIG. 7 is a sectional view of an adjacent pair of blades engaged to the damper assembly of FIG. 2.

FIG. 7 shows the surfaces 58 and 60 respectively engaging the surfaces 142 and 108 of adjacent blades in an installed condition. In the exemplary embodiment, the surface 58 is positioned essentially radially relative to the engine axis and is essentially flat, as is the mating surface 142. The surface 60, however, may be less flat, namely slightly convex in transverse section such as having a radius of curvature of one or more values in an exemplary range of approximately 5–30 mm, more particularly 10–25 mm and, most particularly 12–20 mm. The transition 150 between the surfaces 58 and 60 and a transition 152 between the surface 60 and more radial inboard portion 154 of the adjacent side of the damper member may be more sharply radiused. For example, the former may be radius at 0.2–1.0 mm and the latter at 0.7–1.5 mm.

Figure 8:
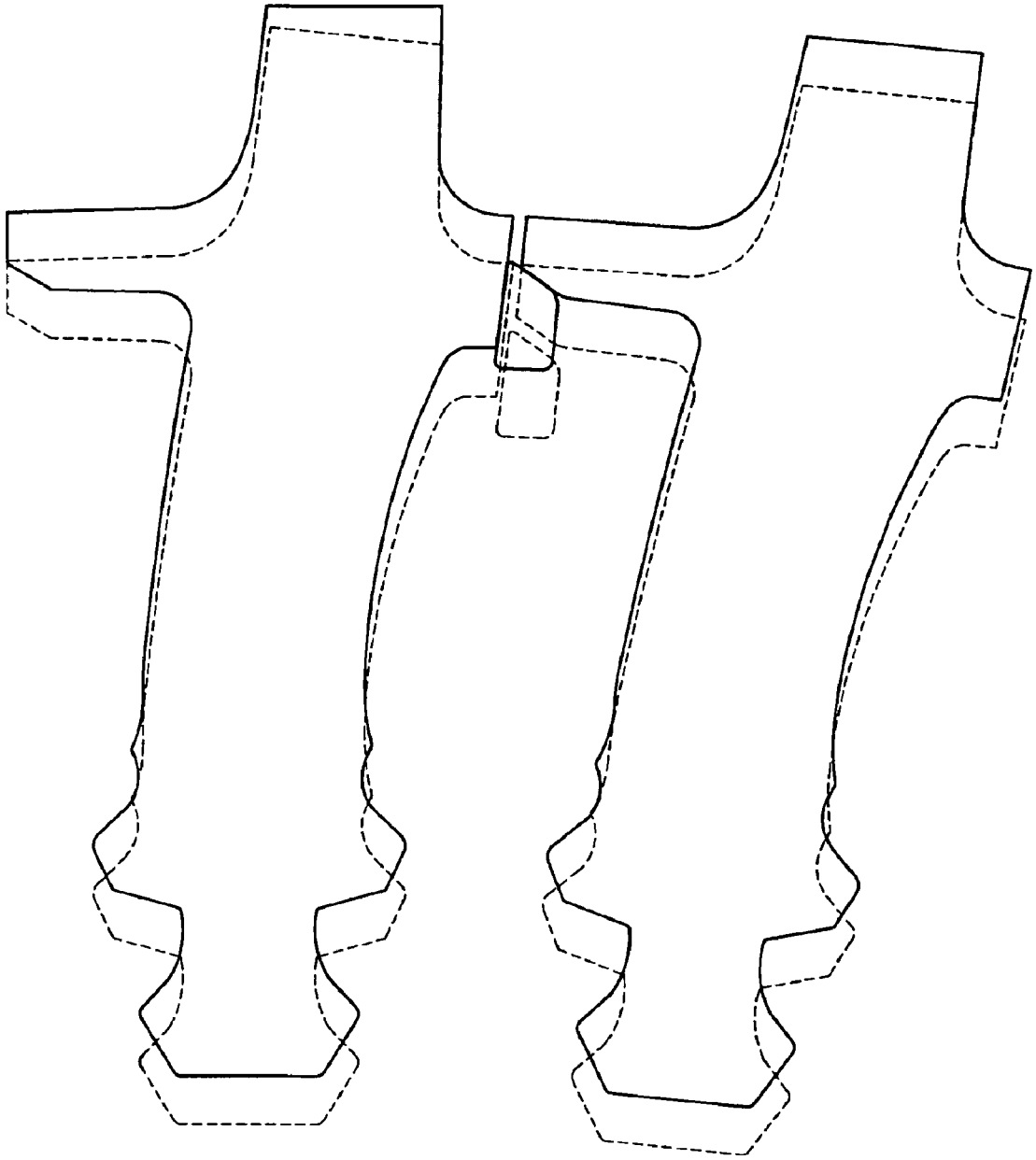
FIG. 8 is a schematic sectional view showing rest and running positions of the blade combination of FIG. 7.

FIG. 8 shows the action of the damper in accommodating movement of the blades between an at-rest position (broken lines) and a running position (solid lines). Wedging engagement is maintain by centrifugal action acting upon the wedge damper to wedge itself between the mating surfaces. An exemplary angle θ between the surface 60 and a characteristic (e.g. mean, median, or central tangent) portion of the surface 58 is between 20°–80°. The illustrated damper main body serves as a "full-length" damper, meaning its associated contact surfaces extend nearly the entire length of the platforms subject to manufacturing constraints. For example, this may be approximately 60–80%.

Figure 9:
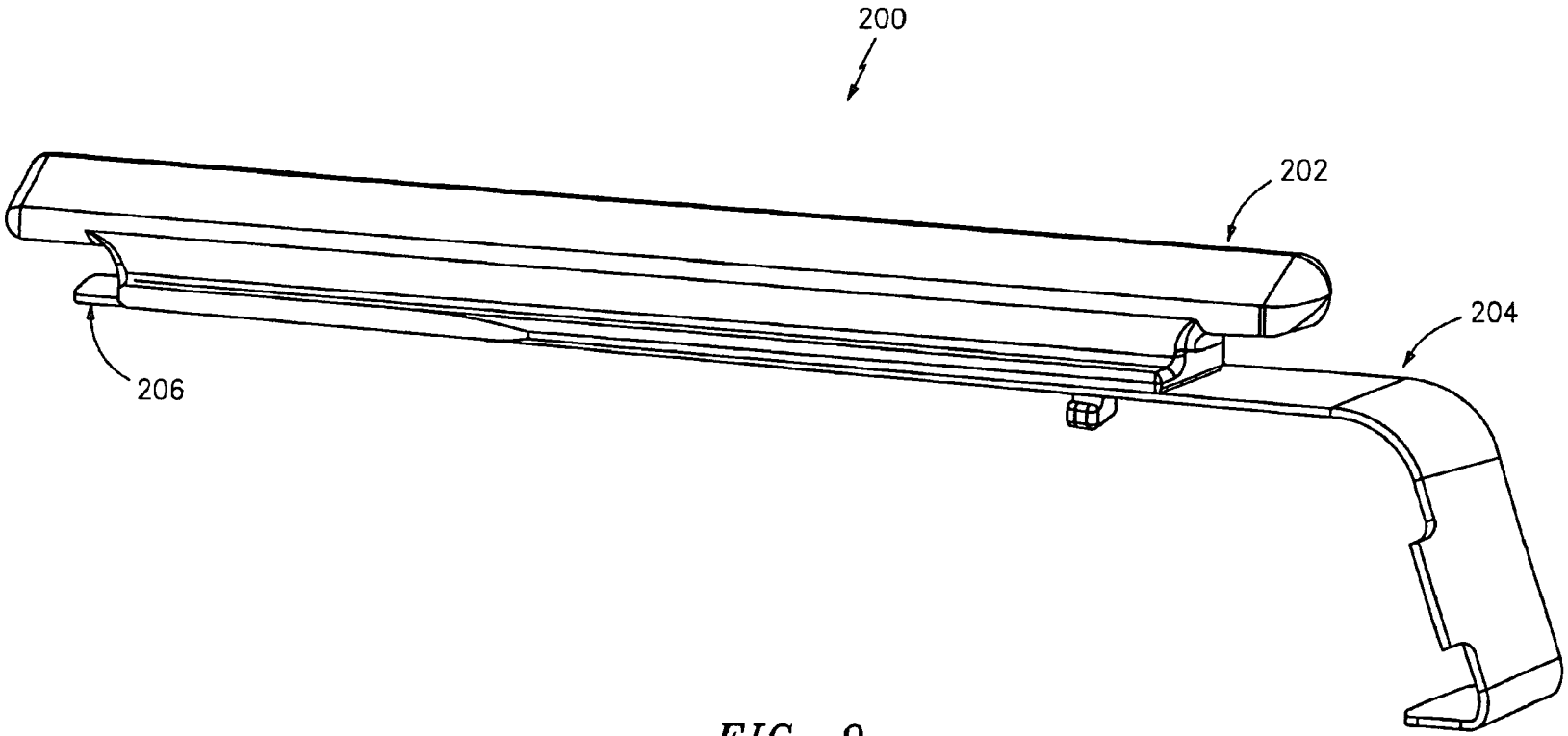
FIG. 9 is a view of a second damper assembly.
Figure 10:
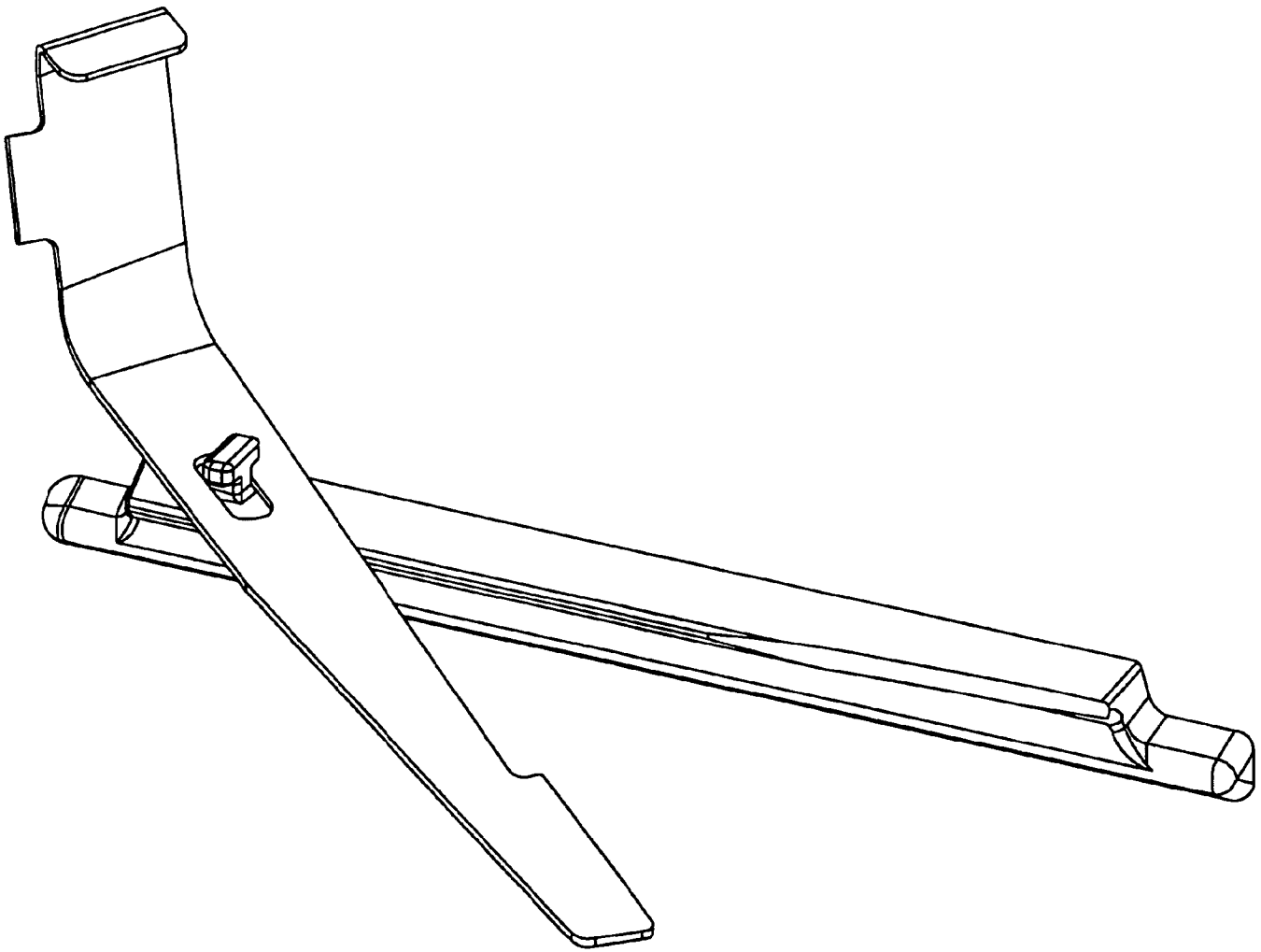
FIG. 10 is a view of the damper assembly of FIG. 9 in an intermediate stage of assembly/disassembly.

FIGS. 9 and 10 show an alternate damper/seal assembly 200 having a damper member 202 and a seal member 204. In the exemplary embodiment, the seal member 204 extends farther upstream than the in first embodiment and has a protruding upstream portion 206 which may be captured within forward pockets 208 (FIG. 5) and 210 (FIG. 6) of the second and first sides of the associated blade platforms/necks. In the illustrated embodiment, a similar T-shaped projection and slot arrangement is provided to couple the two pieces. The increased length of the seal member 204 provides additional protection against infiltration of hot upstream gases over the length of the platform.

Figure 11:
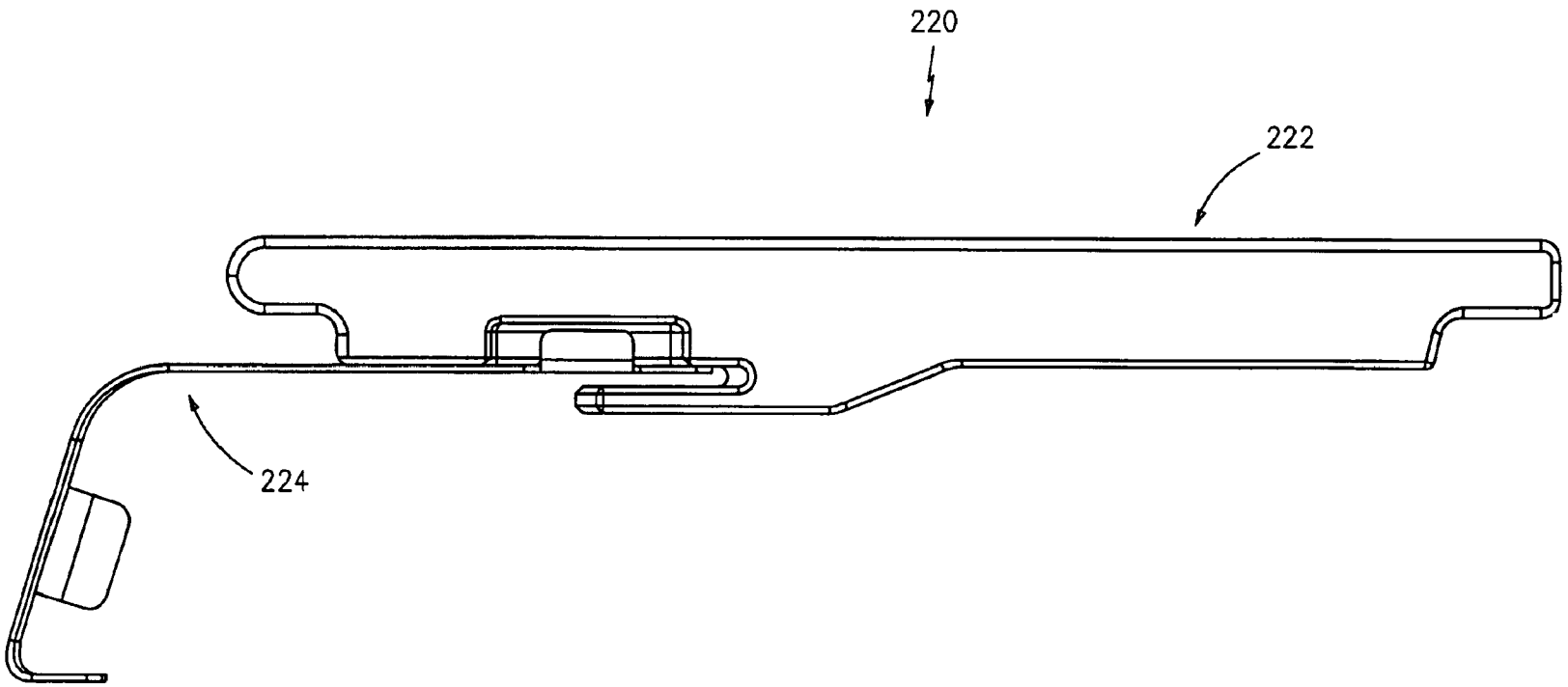
FIG. 11 is a view of a third damper assembly.
Figure 12:
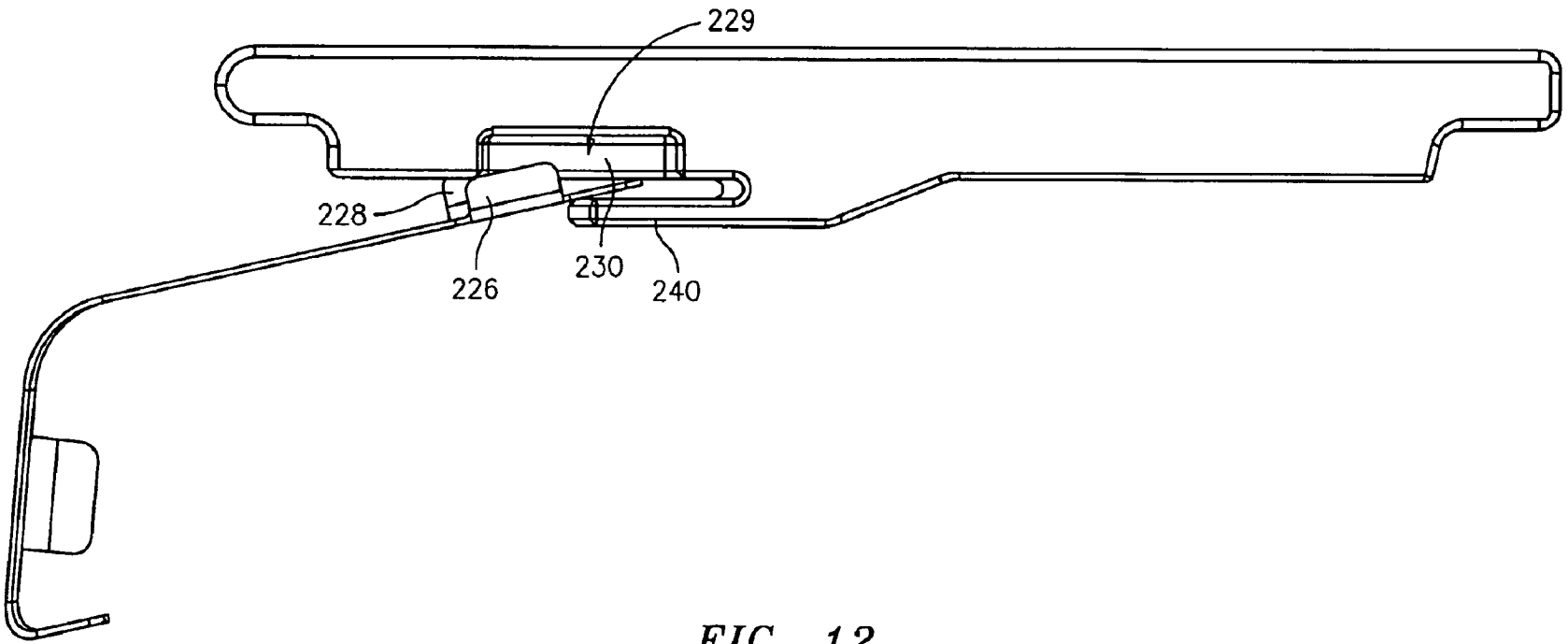
FIG. 12 is a view of the third damper assembly of FIG. 11 in an intermediate stage of assembly/disassembly.

FIGS. 11 and 12 show a third damper/seal assembly 220 having a damper member 222 and a seal member 224. A pair of projections 226 and 228 extending outboard from opposite sides of the shelf (shown partially assembled in FIG. 12) become accommodated within compartments 229 on either side of the seal and straddle a web 230 between the compartments. An upstream portion of the shelf ahead of the projections may be captured between a tongue 240 and the rest of the damper member. To assemble the two components, the upstream portion of the shelf may be inserted within the channel at a slight angle and then the seal may be rotated outward with further insertion bringing the projections into the associated recesses.

One or more embodiments of the present invention have been described. Nevertheless, it will be understood that various modifications may be made without departing from the spirit and scope of the invention. For example, when applied as a reengineering of an existing turbine engine, details of the existing engine may influence details of any particular implementation. Accordingly, other embodiments are within the scope of the following claims.

What is claimed is:

1. A turbomachine blade damper comprising:

a damper member having first and second damping surfaces for respectively engaging first and second surfaces of adjacent first and second blades, the first and second damping surfaces angled relative to each other so as to provide a wedging engagement between the first and second blades; and a seal having:

a first portion engaged to the damping member to resist movement of the seal in at least one direction; and a second portion for restricting gas flow by at least one of the blades.

2. The apparatus of claim 1 wherein:

the seal consists essentially of sheet metal; and the damper member consists essentially of cast or machined metal.

3. The apparatus of claim 2 wherein:

the seal consists essentially of a nickel- or cobalt-based superalloy; and the damper member consists essentially of a nickel- or cobalt-based superalloy.

4. The apparatus of claim 1 wherein:

the damper member retains the seal against axial movement in at least one direction and against inward radial movement.

5. The apparatus of claim 1 wherein:

one of said first and second damping surfaces has a radiused transverse section; and the other of said first and second damping surfaces is flat relative to said one.

6. The apparatus of claim 1 wherein:

the second portion of the seal is at least partially wider than the damper member.

7. The apparatus of claim 1 wherein:

the second portion of the seal has a radial span of at least 2.0 mm and a circumferential span of at least 4.0 mm.

8. The apparatus of claim 1 wherein:

the second portion of the seal is, in major part, radially inboard of the damper member.

9. The apparatus of claim 1 wherein:

the damper member has a depending T-shaped projection; and the seal has a closed aperture accommodating a leg of the projection with an adjacent portion of the seal being captured by an underside of a head of the projection and wherein the adjacent portion may be freed by a relative rotation about an axis of the leg to an orientation wherein the projection head may be extracted through the aperture.

10. A method for assembling the turbomachine blade damper of claim 1 comprising:

bringing the damper member and the seal together in a first orientation so that a projection of the damping member passes into an aperture in the seal;

relatively rotating the damper member and seal to a second orientation wherein the projection captures an adjacent portion of the retainer.

11. The apparatus of claim 1 wherein:

one of said first and second damping surfaces is essentially radial.

12. The apparatus of claim 1 wherein:

a characteristic angle between the first and second damping surfaces is 20–80°.

13. A turbomachine blade combination comprising:

first and second blades, each having:

a root;

an airfoil outboard of the root; and a platform and neck between the root and airfoil and having first and second sides, the first side of one of the blades facing the second side of the other; and means mounted in at least one pocket of at least one of the facing first and second sides for damping relative motion of the first and second blades and sealing against combustion gas upstream infiltration, the means having first and second damping surfaces for respectively engaging first and second surfaces of adjacent first and second blades, the first and second damping surfaces angled relative to each other so as to provide a wedging engagement between the first and second blades.

14. A turbomachine blade damper comprising:

a damper member having first and second damping surfaces for respectively engaging first and second surfaces of adjacent first and second blades wherein:

one of said first and second damping surfaces has a radiused transverse section; and the other of said first and second damping surfaces is flat relative to said one; and a seal having:

a first portion engaged to the damping member to resist movement of the seal in at least one direction; and a second portion for restricting gas flow by at least one of the blades.

15. A turbomachine blade damper comprising:

a damper member having first and second damping surfaces for respectively engaging first and second surfaces of adjacent first and second blades; and a seal having:

a first portion engaged to the damping member to resist movement of the seal in at least one direction; and a second portion for restricting gas flow by at least one of the blades and having a radial span of at least 2.0 mm and a circumferential span of at least 4.0 mm.

16. A turbomachine blade damper comprising:

a damper member having first and second damping surfaces for respectively engaging first and second surfaces of adjacent first and second blades; and a seal having:

a first portion engaged to the damping member to resist movement of the seal in at least one direction; and a second portion for restricting gas flow by at least one of the blades, wherein:

the damper member has a depending T-shaped projection; and the seal has a closed aperture accommodating a leg of the projection with an adjacent portion of the seal being captured by an underside of a head of the projection and wherein the adjacent portion may be freed by a relative rotation about an axis of the leg to an orientation wherein the projection head may be extracted through the aperture.

17. A method for assembling a turbomachine blade damper, the turbomachine blade damper comprising:

a damper member having first and second damping surfaces for respectively engaging first and second surfaces of adjacent first and second blades; and a seal having:

a first portion engaged to the clamping member to resist movement of the seal in at least one direction; and a second portion for restricting gas flow by at least one of the blades the method comprising:

bringing the damper member and the seal together in a first orientation so that a projection of the damping member passes into an aperture in the seal; and relatively rotating the damper member and seal to a second orientation wherein the projection captures an adjacent portion of the retainer.

18. A turbomachine blade damper comprising:

a damper member having first and second damping surfaces for respectively engaging first and second surfaces of adjacent first and second blades; and a seal having:

a first portion engaged to the damping member to resist movement of the seal in at least one direction; and a second portion for restricting gas flow by at least one of the blades, wherein:

the damper member has a depending projection; and the seal has an aperture accommodating a leg of the projection with an adjacent portion of the seal being captured by an underside of a head of the projection.

19. A turbomachine blade damper comprising:

a damper member having:

a main body with first and second damping surfaces for respectively engaging first and second surfaces of adjacent first and second blades; and a tongue radially inboard of the main body and combining therewith to form a channel; and a seal having:

a first portion extending within the channel and engaged to the damping member to resist inward radial movement of the seal; and a second portion for restricting gas flow by at least one of the blades.

20. The damper of claim 19 wherein:

the seal first portion is part of a shelf portion from which at least one tab extends outboard.

21. A turbomachine blade damper and blade combination comprising:

a damper member retaining the seal against axial movement in at least one direction and against inward radial movement and having first and second damping surfaces for respectively engaging first and second surfaces of adjacent first and second blades, the first and second damping surfaces extending 60–80% of a length of platforms of the first and second blades; and a seal having:

a first portion engaged to the damping member to resist movement of the seal in at least one direction; and a second portion for restricting gas flow by at least one of the blades.

22. A turbomachine blade damper comprising:

a damper member having:

a main body with first and second damping surfaces for respectively engaging first and second surfaces of adjacent first and second blades; and a tongue inboard of the main body and combining therewith to form a channel; and a seal having:

a first portion extending within the channel and engaged to the damping member to resist of the seal in at least one direction; and a second portion for restricting gas flow by at least one of the blades, the seal first portion being part of a shelf portion from which at least one tab extends outboard.

* * * * *

UNITED STATES PATENT AND TRADEMARK OFFICE

CERTIFICATE OF CORRECTION

PATENT NO. : 6,932,575 B2
APPLICATION NO. : 10/681957
DATED : August 23, 2005
INVENTOR(S) : Raymond Surace et al.

It is certified that error appears in the above-identified patent and that said Letters Patent is hereby corrected as shown below:

Column 7, claim 17 line 2, “clamping” should read --damping--.

Signed and Sealed this

Seventeenth Day of April, 2007

JON W. DUDAS
*Director of the United States Patent and Trademark Office*